US011735835B2

(12) United States Patent
Smith, Jr. et al.

(10) Patent No.: US 11,735,835 B2
(45) Date of Patent: Aug. 22, 2023

(54) IMPEDANCE CONTROL COMPONENT FOR ATTACHING TO A WIRE

(71) Applicant: TE Connectivity Services GmbH, Schaffhausen (CH)

(72) Inventors: Graham H. Smith, Jr., Mechanicsburg, PA (US); Keith E. Miller, Manheim, PA (US)

(73) Assignee: TE Connectivity Solutions GmbH, Schaffhausen (CH)

( * ) Notice: Subject to any disclaimer, the term of this patent is extended or adjusted under 35 U.S.C. 154(b) by 412 days.

(21) Appl. No.: 17/090,536

(22) Filed: Nov. 5, 2020

(65) Prior Publication Data

US 2022/0140500 A1 May 5, 2022

(51) Int. Cl.
*H01R 4/2441* (2018.01)

(52) U.S. Cl.
CPC ..... *H01R 4/2441* (2013.01)

(58) Field of Classification Search
CPC ..... H01R 13/6474; H01R 4/2441
See application file for complete search history.

(56) References Cited

U.S. PATENT DOCUMENTS

2014/0051295 A1* 2/2014 Westman ..... H01R 13/518 439/626

FOREIGN PATENT DOCUMENTS

CN 202601879 U * 12/2012
CN 107205469 A * 9/2017 ..... A24F 40/53

* cited by examiner

*Primary Examiner* — Jean F Duverne

(57) ABSTRACT

An electrical connector assembly having a housing with terminal receiving passages. The terminal receiving passages have wire receiving portions. Wires are positioned in the wire receiving portions. The wires have cable jackets and center conductors. Electrically conductive components for controlling impedance of sections of the wires are positioned in the wire receiving portions of the terminal receiving passages. The electrically conductive components includes base walls with end walls, The end walls extend in a direction which is essentially perpendicular to planes of the base walls. The base walls have lengths which are approximately equal to lengths of the wire receiving portions of the terminal receiving passages. Insulation displacement slots are provided on the end walls. Lead-in sections extend from the insulation displacement slots in a direction away from the base wall.

20 Claims, 4 Drawing Sheets

IMPEDANCE CONTROL COMPONENT FOR ATTACHING TO A WIRE

FIELD OF THE INVENTION

The present invention is directed to a component which is attached to a wire to control the impedance. In particular, the invention is directed to a component which is electrically and mechanically attached to a section of wire for the purpose of changing the impedance to minimize undesired impedance discontinuities that are detrimental to the performance of the connector.

BACKGROUND OF THE INVENTION

Controlled impedance in connectors is important for maintaining signal integrity. However, in cable type connectors, the transition or wire management area between the cable and the terminal terminated to the end of the cable can provide various challenges. The cable arrives in the wire management area is intact, with the center conductor maintained in the cable jacket, thereby providing a well-controlled impedance path. Part of this controlled path, for instance, can be a twisted pair arrangement for a differential path. However, when positioned in the connector, the individual wires must be separated and straightened, with the straightened portion of each of the wires being positioned in respective terminal receiving passages. In this wire management area, the impedance is different than the impedance of the twisted cable. Consequently, the wire management region has undesired impedance discontinuities that are detrimental to the performance of the connector.

It would be, therefore, beneficial to provide a component which is attached to individual wires to control the impedance in the wire management zone to eliminate or minimize undesired impedance discontinuities that are detrimental to the performance of the connector. In particular, it would be beneficial to provide a component which is electrically and mechanically attached to a section of wire for the purpose of minimizing undesired impedance discontinuities that are detrimental to the performance of the connector.

SUMMARY OF THE INVENTION

An embodiment is directed to a conductive member for controlling impedance for use in an electrical connector.

An embodiment is directed to an electrically conductive component for controlling impedance of a section of wire positioned in a wire receiving portion of a terminal receiving passage of an electrical connector. The electrically conductive component includes a base wall with end walls. The end walls extend in a direction which is essentially perpendicular to a plane of the base wall. The base wall has a length which is approximately equal to a length of the wire receiving portion of the terminal receiving passage. Insulation displacement slots are provided on the end walls. Lead-in sections extending from the insulation displacement slots in a direction away from the base wall.

An embodiment is directed to an electrical connector assembly. The electrical connector assembly has a housing with terminal receiving passages. The terminal receiving passages have wire receiving portions. Wires are positioned in the wire receiving portions. The wires have cable jackets and center conductors. Electrically conductive components for controlling impedance of sections of the wires are positioned in the wire receiving portions of the terminal receiving passages. The electrically conductive components includes base walls with end walls, The end walls extend in a direction which is essentially perpendicular to planes of the base walls. The base walls have lengths which are approximately equal to lengths of the wire receiving portions of the terminal receiving passages. Insulation displacement slots are provided on the end walls. Lead-in sections extend from the insulation displacement slots in a direction away from the base wall.

Respective individual wires inserted into the electrically conductive components, the base walls and side walls of each electrically conductive component are spaced equidistant from a longitudinal axis of each of the respective individual wires. The base walls and side walls of each electrically conductive component extend in a direction which is essentially parallel to a longitudinal axis of a straightened portion of respective individual wires which are positioned in the wire receiving portions. The base walls and side walls are spaced from the center conductors of the wires a defined distance, wherein the impedance between the wires in the wire receiving portions of the terminal receiving passages matches or is approximately the same as the impedance of the wires in twisted sections of the wires.

Other features and advantages of the present invention will be apparent from the following more detailed description of the preferred embodiment, taken in conjunction with the accompanying drawings which illustrate, by way of example, the principles of the invention.

DETAILED DESCRIPTION OF THE INVENTION

Figure 1:
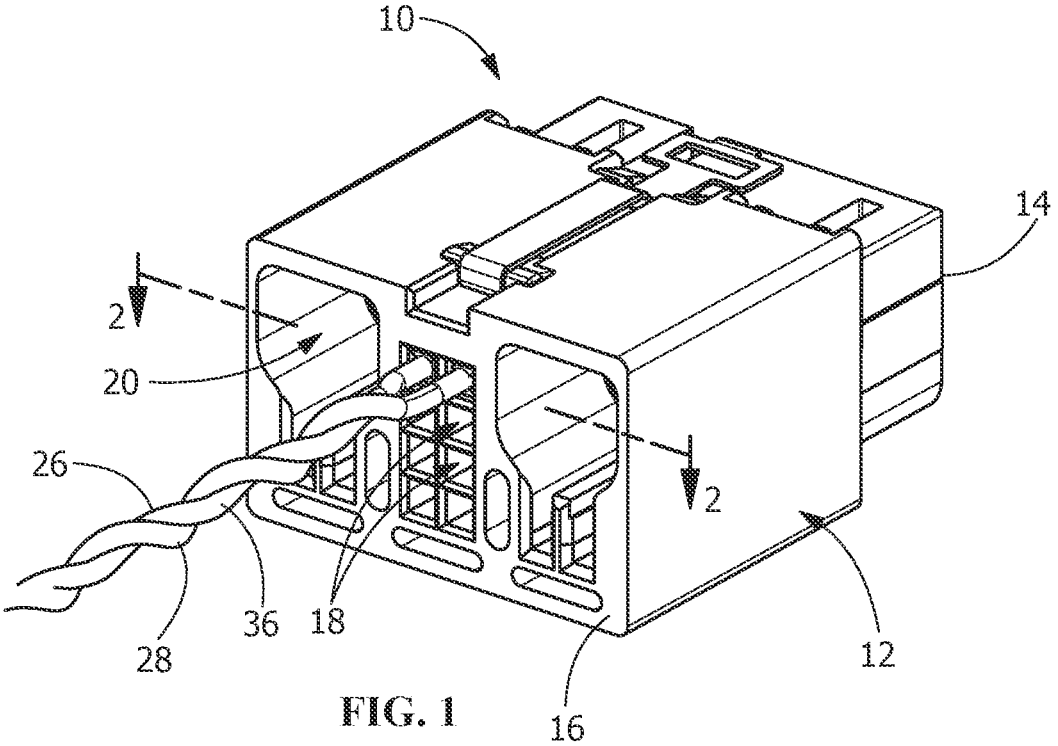
FIG. 1 is a perspective view of an electrical connector of the present invention with multiple wires positioned in wire receiving cavities.

The description of illustrative embodiments according to principles of the present invention is intended to be read in connection with the accompanying drawings, which are to be considered part of the entire written description. In the description of embodiments of the invention disclosed herein, any reference to direction or orientation is merely intended for convenience of description and is not intended in any way to limit the scope of the present invention. Relative terms such as "lower," "upper," "horizontal," "vertical," "above," "below," "up," "down," "top" and "bottom" as well as derivative thereof (e.g., "horizontally," "downwardly," "upwardly," etc.) should be construed to refer to the orientation as then described or as shown in the drawing under discussion. These relative terms are for convenience of description only and do not require that the apparatus be constructed or operated in a particular orientation unless explicitly indicated as such. Terms such as "attached," "affixed," "connected," "coupled," "interconnected," and similar refer to a relationship wherein structures are secured or attached to one another either directly or indirectly through intervening structures, as well as both movable or rigid attachments or relationships, unless expressly described otherwise.

Moreover, the features and benefits of the invention are illustrated by reference to the preferred embodiments. Accordingly, the invention expressly should not be limited to such embodiments illustrating some possible non-limiting combination of features that may exist alone or in other combinations of features, the scope of the invention being defined by the claims appended hereto.

Figure 2:
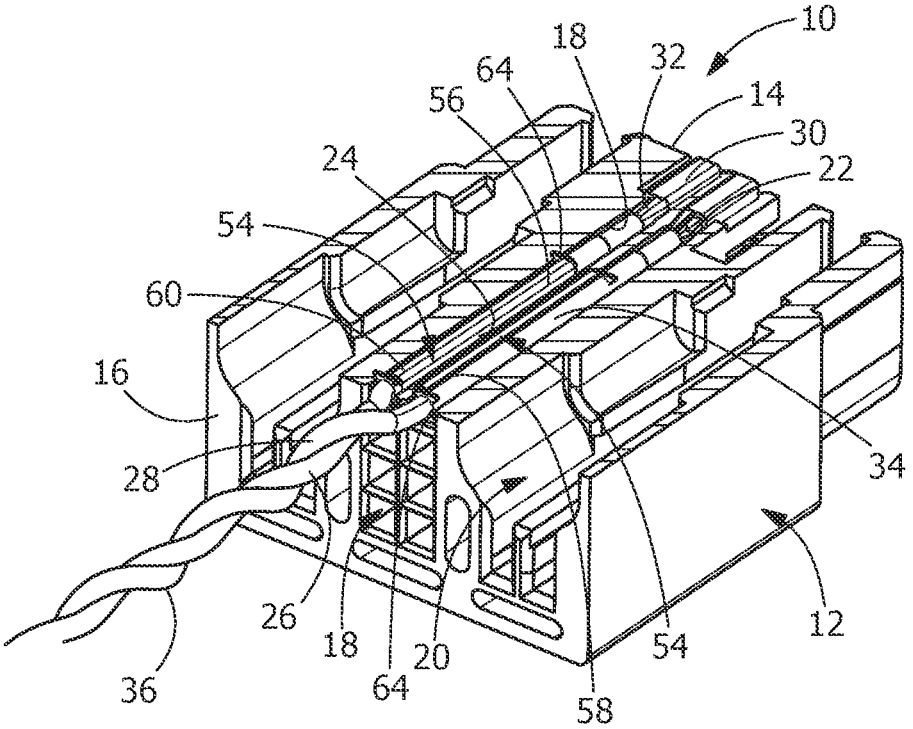
FIG. 2 is a cross-sectional view taken along line 2-2 of FIG. 1, illustrating a pair of wires positioned in wire receiving cavities of the housing of the connector, the wires have illustrative conductive components of the present invention attached thereto.

As shown in FIGS. 1 and 2, an electrical connector assembly 10 has a housing 12 with a mating end 14 and a cable receiving end 16. Terminal receiving cavities or passages 18 extend between the mating end 14 and the cable receiving end 16. Other component receiving cavities or passages 20 may be provided in the housing 12 of the electrical connector assembly 10. The other component receiving passages 20 may be configured to receive various components (not shown), such as, but not limited to, power terminals.

In the illustrative embodiment shown, the terminal receiving passages 18 are positioned in two columns with four rows in each column. However, other configurations and orientations of the terminal receiving passages 18 may be provided without departing from the scope of the invention. As shown in FIG. 2, each terminal receiving passage 18 has a terminal receiving portion 22 and a wire receiving portion 24.

As shown FIG. 1 through 4, wires 26, 28, have terminals 30 which are terminated at a free end thereof. Prior to being positioned in the housing 12 of the connector assembly 10, the wires 26, 28 are commonly twisted together to obtain a desired impedance. However, upon being positioned in the terminal receiving passages 18, the wires 26, 28 must be separated and straightened, with the straightened portion 34 of each of the wires 26, 28 being positioned in respective terminal receiving passages 18.

Figure 4:
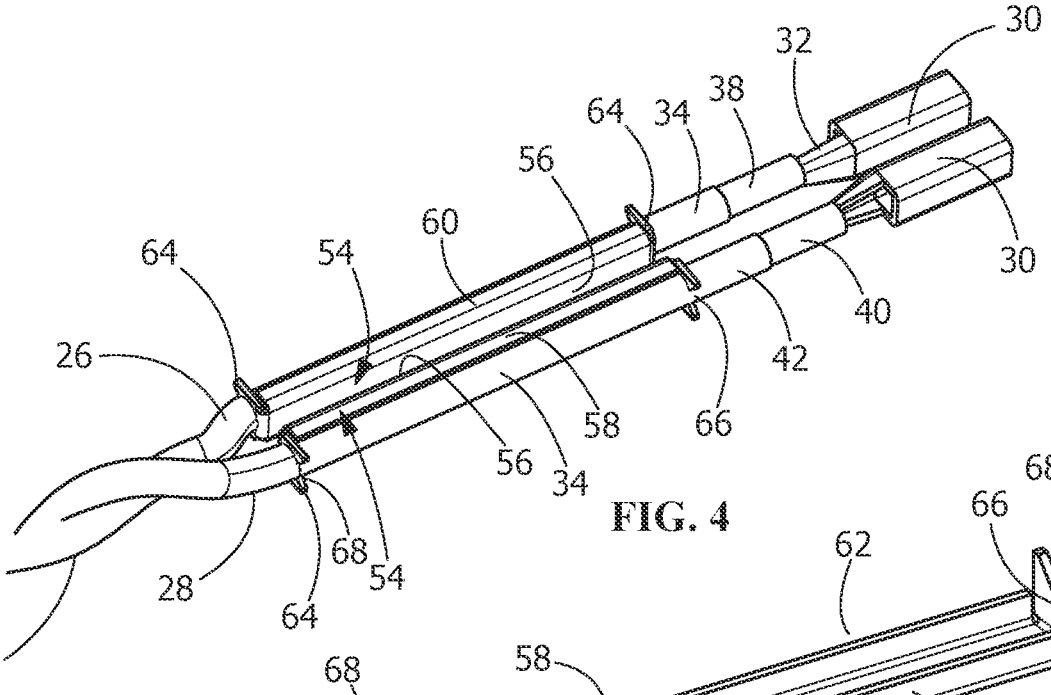
FIG. 4 is a perspective view of the pair of wires shown in FIG. 2 shown removed from the housing of the connector, the wires have the illustrative conductive components shown in FIG. 2 attached thereto.

Each of the wires 26, 28 can transfer data between and among storage devices, switches, routers, printed circuit boards (PCBs), analog to digital converters, connectors, and other devices. As shown in FIG. 4, each of the wires 26, 28 has center conductors 38 which is surrounded by individual cable jackets or dielectrics 42.

The spacing of the terminal receiving passages 18 is determined by the spacing required for the terminals 30 to mate with mating terminals (not shown) of a mating connector (not shown). Consequently, the spacing of the terminal receiving passages 18 is not optimized to maintain the specific impedance of the wires 26, 28 which is provided in a twisted section 36 of the wires 26, 28.

Figure 3:
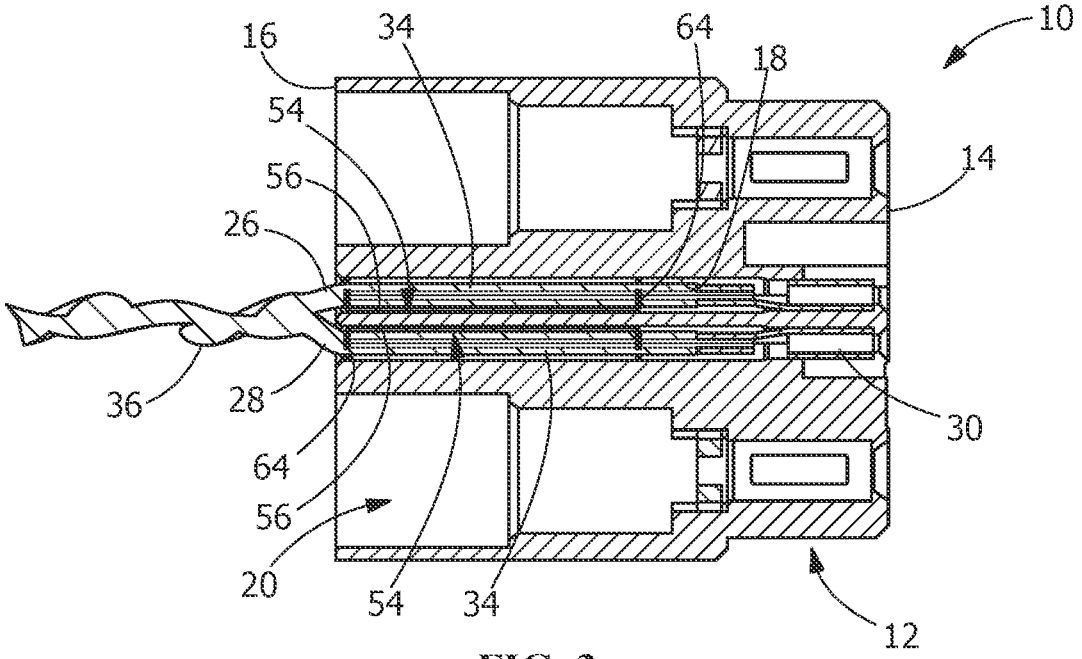
FIG. 3 is a cross-sectional view taken along line 2-2 of FIG. 1, showing the cross-section of the wires.
Figure 5:
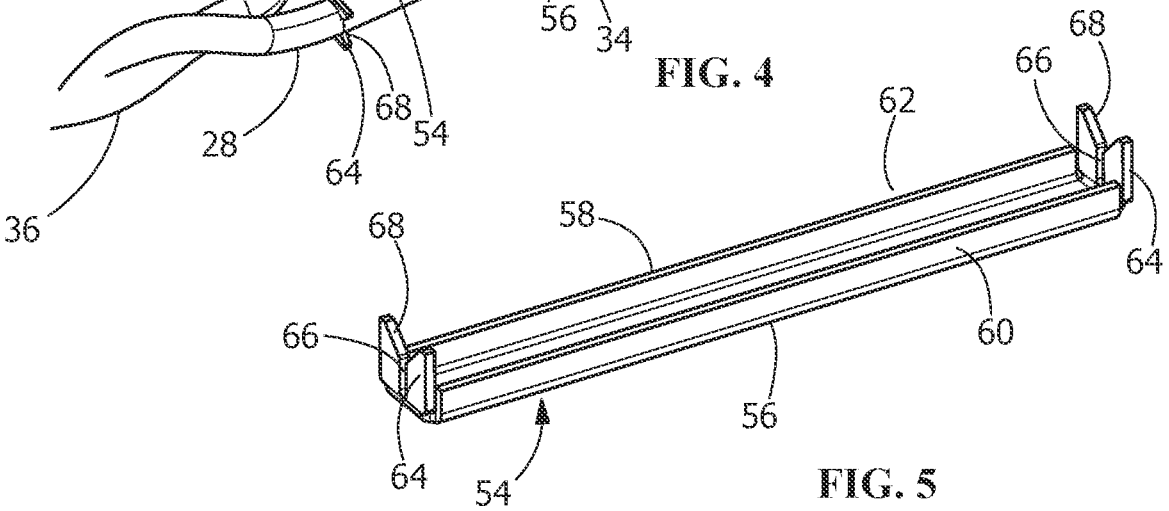
FIG. 5 is a perspective view of the illustrative embodiment of the conductive component shown in FIGS. 2 and 4.

As shown in FIGS. 2 through 4, the straightened portions 34 of the wire 26, 28 have electrically conductive components 54 which are electrically and mechanically attached to the straightened portions 34 of the wire 26, 28. As shown in FIG. 5, each of the conductive components 54 have a base wall 56, a first side wall 58 which extends from the base wall 56, and a second side wall 60 which extends from the base wall 56. Open sides 62 are provided opposite the base walls 56 and extend between the first sidewalls 58 and the second side walls 60. In the illustrative embodiment shown, the first sidewalls 58 and the second side walls 60 are essentially parallel to each other. End walls 64 are provided at either end of the base walls 56 and extend between the first sidewalls 58 and the second side walls 60, in a direction which is essentially perpendicular to the plane of the base wall 56. Insulation displacement slots 66 are provided on the end walls 64. Lead-in sections 68 extend from the insulation displacement slots 66 in a direction away from the base walls 56. Each of the conductive components 54 have a length which is approximately equal to the length of the wire receiving portion 24 of the terminal receiving passage 18.

As shown in FIGS. 2 and 4, terminals 30 are terminated to ends of the conductors 38 of the wires 26, 28. Wire terminating portions 32 of the terminals 30 may be crimped to the conductors 38. However, other methods of terminating the terminals 30 to the conductors 20, 22 may be used.

In use, the individual wires 26, 28 are inserted into respective conductive components 54 prior to being inserted into the terminal receiving passage 18 of the housing 12 of the connector assembly 10. As the individual wires 26, 28 are inserted, the wires 26, 28 are moved into the lead-in sections 68 of the end walls 64 and then into the insulation displacement slots 66. As this occurs the insulation displacement slots 66 penetrate the cable jacket 42, causing the end walls 64 to be placed in electrical engagement with the center conductor 38, 40, thereby providing an electrical pathway between the center conductor 38, 40 and the conductive component 54.

With the individual wires 26, 28 properly inserted into the conductive components 54, the base wall 56 and side walls 58, 60 of each component 54 are spaced equidistant from the longitudinal axis of each of the respective wires 26, 28. As shown in FIG. 3, the base wall 56 and side walls 58, 60 of each component 54 extend in a direction which is essentially parallel to a longitudinal axis of the straightened portion 34 of each wire 26, 28. The base wall 56 and side walls 58, 60 are spaced from the center conductors 38 of the wires 26, 28 a defined distance, wherein the impedance between the wires 26, 28 in the wire receiving portions 24 of the terminal receiving passages 18 matches or is approximately the same as the impedance of the wires 26, 28 in the twisted section 36 of the wires 26, 28.

With the terminals 30 properly terminated to the conductors 38 and the conductive components 54 properly terminated to the wires 26, 28, the terminals 30 and the conductive components 54 are inserted into the terminal receiving passages 18. As the insertion occurs, the conductive components 54 are oriented to optimize the impedance. As shown in FIGS. 2 through 4, the base wall 56 and side walls 58, 60 of the conductive component 54 in a respective terminal receiving passage 18 are positioned to face adjacent terminal receiving passages 18. The open sides 62 are oriented to face away from the adjacent terminal receiving passages 18. In so doing, the impedance of the straightened portion 34 of the wires 26, 28 are optimized to match the impedance of the wires 26, 28 in the twisted section 36 of the wires 26, 28.

With the terminals 30 and conductive components 54 properly inserted, the terminals 30 are secured in the terminal receiving portions 22 using known means. In this position, the conductive components 54 are prevented from rotational movement in the wire receiving portions 24 of the terminal receiving passages 18, as the dimensions of the wire receiving portions 24 of the terminal receiving passages 18 are approximately equal to, but slightly larger, than the dimensions of the conductive components 54.

Figure 6:
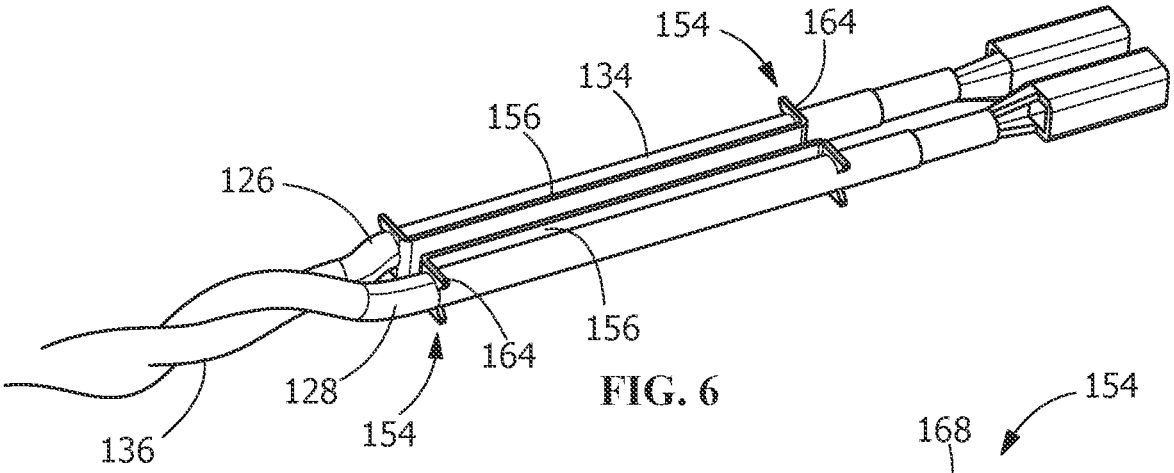
FIG. 6 is a perspective view of a pair of wires shown removed from the housing of the connector, the wires have a first alternate illustrative conductive components attached thereto.
Figure 7:
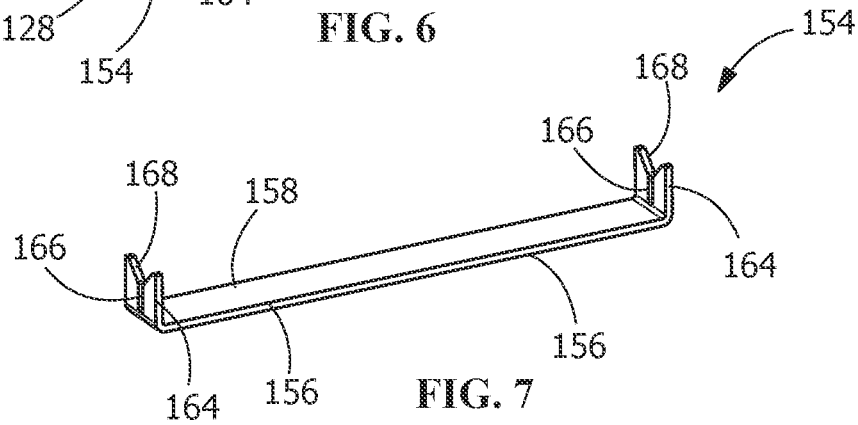
FIG. 7 is a perspective view of the first alternate illustrative embodiment of the conductive component shown in FIG. 6.
Figure 8:
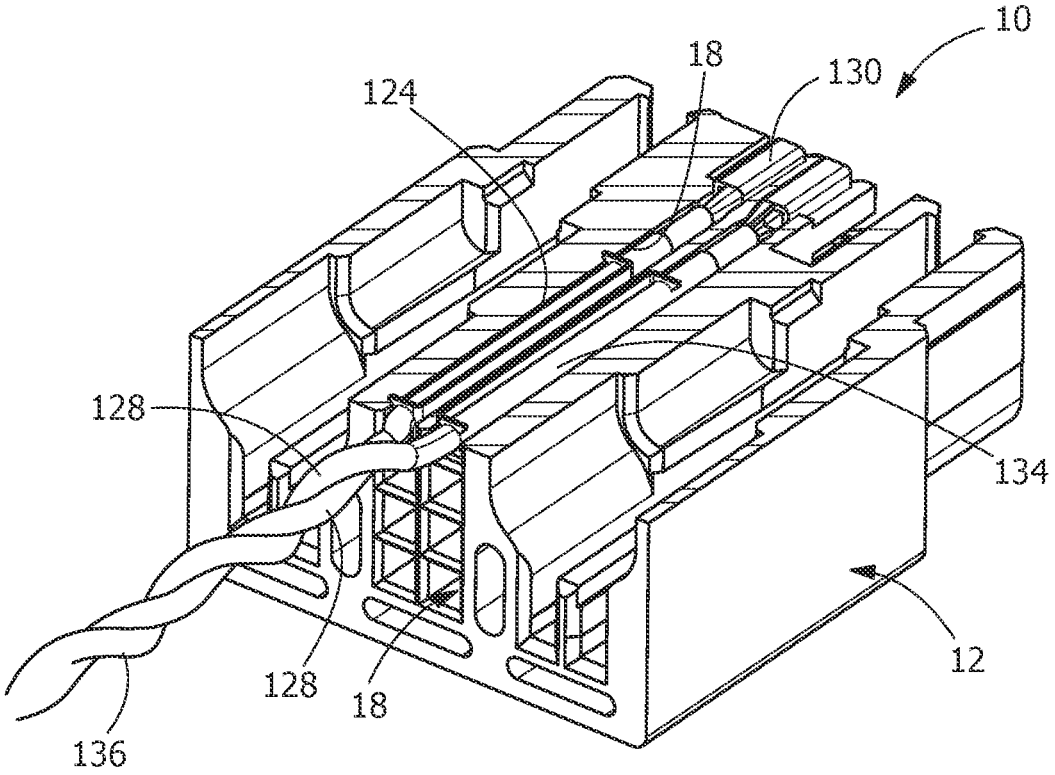
FIG. 8 is a cross-sectional view illustrating the pair of wires of FIG. 6 positioned in wire receiving cavities of the housing of the connector.

Referring to FIGS. 6 through 8, alternate conductive members 154 are shown. In this embodiment, the conductive members 154 have base walls 156 with end walls 164. Open sides 158, 160 and 162 extend between the end walls 164. Insulation displacement slots 166 are provided on the end walls 164. Lead-in sections 168 extend from the insulation displacement slots 166 in a direction away from the base walls 156. Each of the conductive components 154 have a length which is approximately equal to the length of the wire receiving portion 24 of the terminal receiving passage 18.

In use, the individual wires 126, 128 are inserted into respective conductive components 154 prior to being inserted into the terminal receiving passage 18 of the housing 12 of the connector assembly 10. As the individual wires 126, 128 are inserted, the wires 126, 128 are moved into the lead-in sections 168 of the end walls 164 and then into the insulation displacement slots 166. As this occurs the insulation displacement slots 166 penetrate the cable jacket, causing the end walls 164 to be placed in electrical engagement with the center conductor, thereby providing an electrical pathway between the center conductor and the conductive component 154.

The base walls 156 are spaced from the center conductors of the wires 126, 128 a defined distance, wherein the impedance between the wires 126, 128 in the wire receiving portions 124 of the terminal receiving passages 118 matches or is approximately the same as the impedance of the wires 126, 128 in the twisted section 136 of the wires 126, 128.

With the terminals 130 properly terminated to the conductors 138, 140 and the conductive components 154 properly terminated to the wires 126, 128, the terminals 130 and the conductive components 154 are inserted into the terminal receiving passages 118. As the insertion continues, the conductive components 154 are oriented to optimize the impedance. The base wall 156 of the conductive component 154 in a respective terminal receiving passage 118 is positioned to face an adjacent terminal receiving passages 118. The open sides 158, 160, 162 are oriented to face away from the adjacent terminal receiving passages 118. In so doing, the impedance of the straightened portion 134 of the wires 126, 128 are optimized to match the impedance of the wires 126, 128 in the twisted section 136 of the wires 126, 128.

Figure 9:
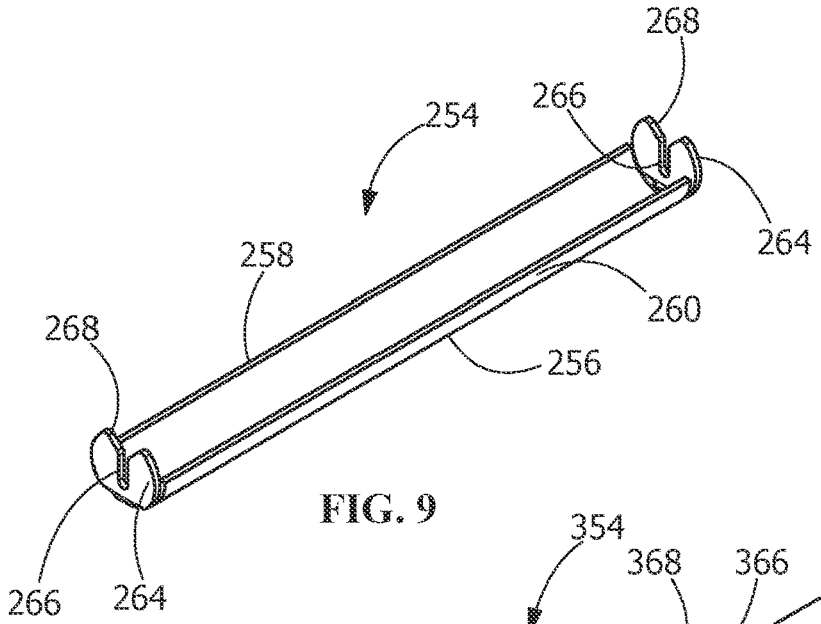
FIG. 9 is a perspective view of a second alternate illustrative conductive component.

FIG. 9 illustrates a second alternate conductive members 254 In this embodiment, the conductive members 254 have rounded or arcuate base walls 256, rounded or arcuate side walls 258, 260 and end walls 264. Insulation displacement slots 266 are provided on the end walls 264. Lead-in sections 268 extend from the insulation displacement slots 266 in a direction away from the base walls 256. Each of the conductive member 254 have a length which is approximately equal to the length of the wire receiving portion 24 of the terminal receiving passage 18. The operation of the conductive members 254 is similar to the operation of the conductive members 54 previously described.

Figure 10:
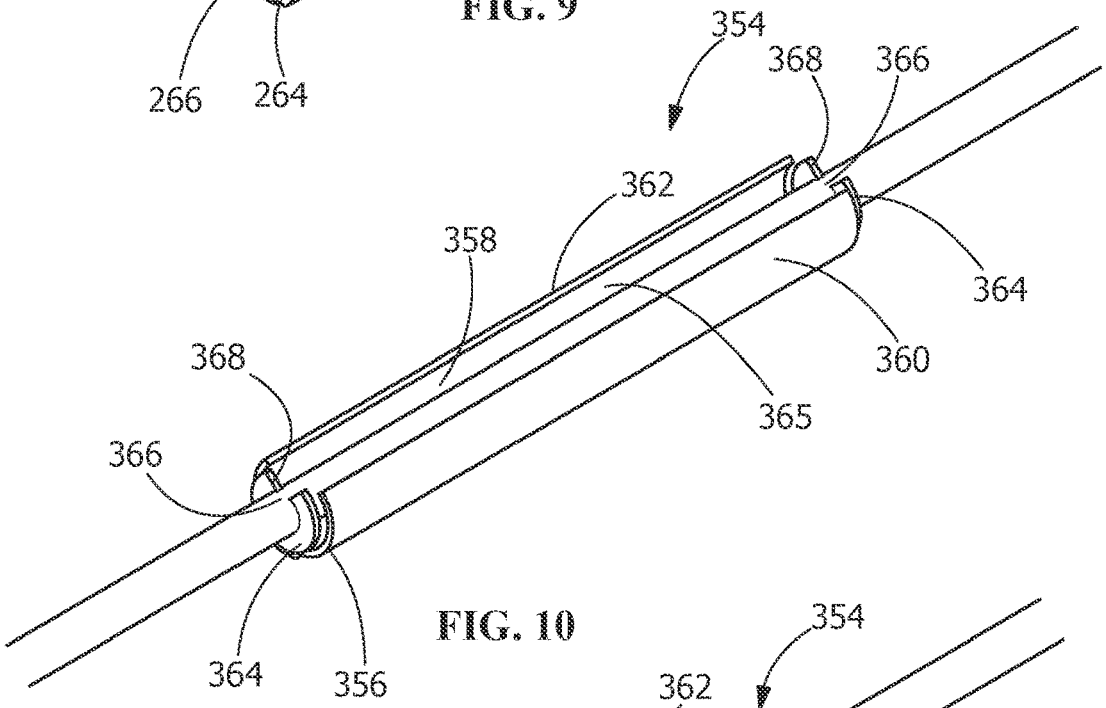
FIG. 10 is a perspective view of a third alternate illustrative conductive component shown in an open position.
Figure 11:
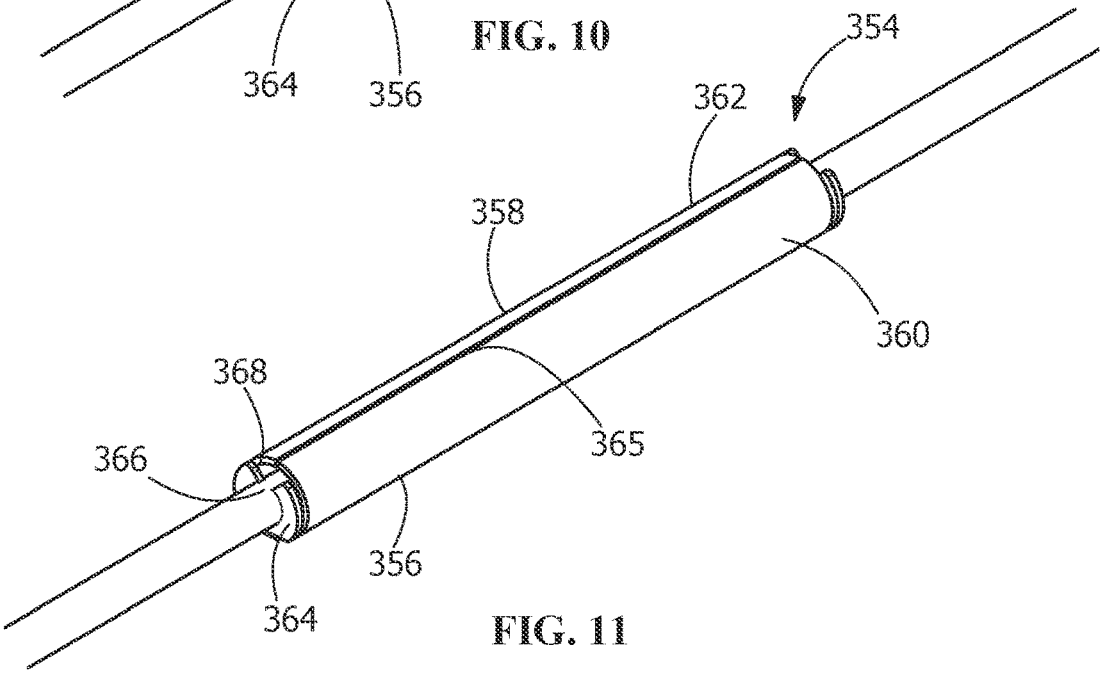
FIG. 11 is a perspective view of the third alternate illustrative conductive component of FIG. 10 shown in a closed position, with a wire extending therethrough.

FIGS. 10 and 11 illustrate a third alternate conductive members 354 In this embodiment, the conductive members 354 have rounded or arcuate base walls 356, rounded or arcuate side walls 358, 360, a rounded upper wall 362 and end walls 364. The rounded upper wall 362 has a slot 365 which extends the length of the upper wall 362 and between the end walls 364. Insulation displacement slots 366 are provided on the end walls 364. Lead-in sections 368 extend from the insulation displacement slots 366 in a direction away from the base walls 356. Each of the conductive components 354 have a length which is approximately equal to the length of the wire receiving portion 24 of the terminal receiving passage 18.

In use, the rounded upper wall 362 is initially provided in an open position, as shown in FIG. 10. The individual wires 326, 328 are inserted into respective conductive components 354 prior to being inserted into the terminal receiving passage 18 of the housing 12 of the connector assembly 10. As the individual wires 326, 328 are inserted, the wires 326, 328 are moved into the lead-in sections 368 of the end walls 364 and then into the insulation displacement slots 366. As this occurs the insulation displacement slots 366 penetrate the cable jacket, causing the end walls 364 to be placed in electrical engagement with the center conductor. With the wires 326, 328 properly terminated the upper wall 362 is moved to a closed position, as shown in FIG. 11. In this position, the walls 356, 358, 360, 362 of each component 354 are spaced equidistant from the longitudinal axis of each of the respective wires 326, 328. The walls 356, 358, 360, 362 are spaced from the center conductors of the wires 326, 328 a defined distance, wherein the impedance between the wires 326, 328 in the wire receiving portions 24 of the terminal receiving passages matches or is approximately the same as the impedance of the wires 326, 328 in the twisted section of the wires 326, 328.

The operation of the conductive members 354 is similar to the operation of the conductive members 54 previously described. However, as the walls 356, 358, 360, 362 encompass the straightened portions 334, the particular orientation of the conductive members 354 does not affect the impedance.

The electrical connector assembly, and in particular, the dielectric housing and the conductive member, provides impedance control and does not damage or required rearrange the conductors, regardless of the particular embodiment. By properly selecting the material used for the conductive member and properly determining the spacing between the terminal receiving passages, the straightened portion of the wires are properly positioned and the impedance of the connector assembly can be tailored to match or approximately match the impedance of the twisted section of the wires, thereby optimizing the performance of the wires and the electrical connector assembly.

While the invention has been described with reference to a preferred embodiment, it will be understood by those skilled in the art that various changes may be made and equivalents may be substituted for elements thereof without departing from the spirit and scope of the invention as defined in the accompanying claims. One skilled in the art will appreciate that the invention may be used with many modifications of structure, arrangement, proportions, sizes, materials and components and otherwise used in the practice of the invention, which are particularly adapted to specific environments and operative requirements without departing from the principles of the present invention. The presently disclosed embodiments are therefore to be considered in all respects as illustrative and not restrictive, the scope of the invention being defined by the appended claims, and not limited to the foregoing description or embodiments.

The invention claimed is:

1. An electrically conductive component for controlling impedance of a section of wire positioned in a wire receiving portion of a terminal receiving passage of an electrical connector, the electrically conductive component comprising:

a base wall having end walls, the end walls extending in a direction which is essentially perpendicular to a plane of the base wall, the base wall having a length which is approximately equal to a length of the wire receiving portion of the terminal receiving passage;

insulation displacement slots provided on the end walls, lead-in sections extending from the insulation displacement slots in a direction away from the base wall;

the base wall is spaced from a center conductor of the section of wire by a defined distance, wherein the impedance between the section of wire matches or is approximately the same as the impedance of a twisted portion of wire which is adjacent to the section of wire.

2. The electrically conductive component as recited in claim 1, wherein an open side is provided opposite the base wall.

3. The electrically conductive component as recited in claim 2, wherein a first side wall extends from the base wall, the first side wall extends between the end walls.

4. The electrically conductive component as recited in claim 3, wherein a second side wall extends from the base wall, the second side wall extends between the end walls, the second side wall is parallel to the first side wall, wherein the base wall, the first side wall and the second side wall are spaced from a center conductor of the section of wire by a defined distance.

5. The electrically conductive component as recited in claim 1, wherein the insulation displacement slots penetrate a cable jacket of the wire, causing the end walls to be placed in electrical engagement with a center conductor of the wire, providing an electrical pathway between the center conductor and the electrically conductive component.

6. The electrically conductive component as recited in claim 1, wherein open sides extend between the end walls.

7. The electrically conductive component as recited in claim 1, wherein the base wall has an arcuate configuration.

8. The electrically conductive component as recited in claim 7, wherein arcuate side walls extend from the base wall, an arcuate upper wall extends from the side walls.

9. The electrically conductive component as recited in claim 8, wherein a slot is provided in the upper wall, the slot extends between the end walls.

10. An electrical connector assembly comprising:

a housing having at least two terminal receiving passages, the at least two terminal receiving passages having wire receiving portions;

wires positioned in the wire receiving portions, the wires having cable jackets and center conductors;

electrically conductive components for controlling impedance of sections of the wires positioned in the wire receiving portions of the terminal receiving passages, the electrically conductive components comprising:

base walls having end walls, the end walls extending in a direction which is essentially perpendicular to planes of the base walls, the base walls having lengths which are approximately equal to lengths of the wire receiving portions of the terminal receiving passages;

insulation displacement slots provided on the end walls, lead-in sections extending from the insulation displacement slots in a direction away from the base wall;

wherein a first base wall of a first conductive component of the electrically conductive components positioned in a first respective terminal receiving passage of the at least two terminal receiving passages is positioned to face a second base wall of a second conductive component of the electrically conductive components positioned in a second respective terminal receiving passage of the at least two terminal receiving passages which is adjacent to the first respective terminal receiving passage;

wherein the impedance of the sections of wires match the impedance of twisted portions of wires adjacent the sections of wires.

11. The electrical connector assembly as recited in claim 10, wherein open sides are provided opposite the base walls.

12. The electrical connector assembly as recited in claim 11, wherein first side walls extend from the base walls, the first side walls extend between the end walls.

13. The electrical connector assembly as recited in claim 12, wherein second side walls extend from the base walls, the second side walls extend between the end walls, the second side walls are parallel to the first side walls.

14. The electrical connector assembly as recited in claim 9, wherein the insulation displacement slots penetrate the cable jackets of the wires, causing the end walls to be placed in electrical engagement with the center conductors of the wires, providing an electrical pathway between the center conductors and the electrically conductive components.

15. The electrical connector assembly as recited in claim 9, wherein open sides extend between the end walls.

16. The electrical connector assembly as recited in claim 9, wherein the base walls have rounded configurations.

17. The electrical connector assembly as recited in claim 16, wherein rounded side walls extend from the base walls, arcuate upper walls extend from the side walls.

18. The electrical connector assembly as recited in claim 17, wherein slots are provided in the upper walls, the slots extend between the end walls.

19. The electrical connector assembly as recited in claim 17, wherein with respective individual wires inserted into the electrically conductive components, the base walls and side walls of each electrically conductive component are spaced equidistant from a longitudinal axis of each of the respective individual wires, the base walls and side walls of each electrically conductive component extend in a direction which is essentially parallel to a longitudinal axis of a straightened portion of respective individual wires which are positioned in the wire receiving portions, the base walls and side walls are spaced from the center conductors of the wires a defined distance, wherein the impedance between the wires in the wire receiving portions of the terminal receiving passages matches or is approximately the same as the impedance of the wires in twisted sections of the wires.

20. The electrical connector assembly as recited in claim 19, wherein terminals are terminated to ends of the wires.

* * * * *